United States Patent [19]

Pearce et al.

[11] 4,312,794

[45] Jan. 26, 1982

[54] ULTRA PURE TETRACHLOROETHYLENE DIELECTRIC FLUID

[75] Inventors: Henry A. Pearce, Stoneboro; Paul Voytik; Edward J. Walsh, both of Hermitage, all of Pa.

[73] Assignee: Electric Power Research Institute, Inc., Palo Alto, Calif.

[21] Appl. No.: 136,650

[22] Filed: Apr. 2, 1980

[51] Int. Cl.[3] ..... H01B 3/24

[52] U.S. Cl. ..... 252/581; 252/578; 252/580

[58] Field of Search ..... 252/66, 63.7, 65, 580, 252/581

[56] References Cited

U.S. PATENT DOCUMENTS

| | | | |
|---|---|---|---|
| 2,019,338 | 10/1935 | Clark | 252/66 |
| 2,752,401 | 6/1956 | Joseph | 260/659 A |

FOREIGN PATENT DOCUMENTS

| | | | |
|---|---|---|---|
| 2042196 | 3/1971 | Fed. Rep. of Germany | 252/63.2 |
| 47-43920 | 11/1972 | Japan | 252/63.7 |
| 765522 | 1/1957 | United Kingdom | 570/108 |

*Primary Examiner*—Mayer Weinblatt

*Attorney, Agent, or Firm*—R. D. Fuerle

[57] ABSTRACT

A transformer is disclosed which contains a dielectric fluid of tetrachloroethylene. The dielectric fluid is ultra pure in that it contains less than 100 ppm of chlorohydrocarbons. A diluent, such as mineral oil, may be mixed with the tetrachloroethylene. The fluid can also contain 30 to 100 ppm of an inhibitor.

15 Claims, 5 Drawing Figures

ULTRA PURE TETRACHLOROETHYLENE DIELECTRIC FLUID

BACKGROUND OF THE INVENTION

Figure 1:
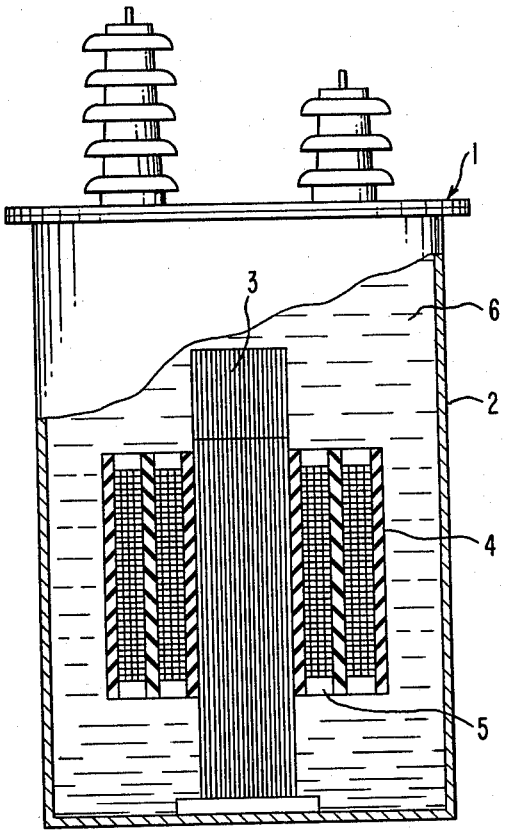

The prohibition against the use of polychlorinated biphenyls (PCB's) as dielectric fluids, because they constitute an environmental hazard, has resulted in an extensive search for suitable substitutes. A good dielectric fluid should not burn, should be fluid over a wide range of temperatures, should be environmentally acceptable, should be inexpensive, and, or course, should have good electrical insulating characteristics. Fluids which have been used to replace PCB's include silicones, phthalate esters, alkylated aromatics, and hydrocarbons. All of these fluids, and indeed any fluid, is a compromise of desirable and undesirable properties. Fluids which excel in one characteristic may be deficient in another desirable characteristic. Generally, there are minimum standards that a fluid must meet, however, which are set by the industry and/or government, before it will be accepted.

RELATED APPLICATIONS

This application is related to application Ser. No. 136,635, titled "Electrical Apparatus," filed concurrently herewith by T. W. Dakin, P. Voytik and C. L. Moore, which discloses an electrical apparatus containing tetrachloroethylene.

PRIOR ART

Clark U.S. Pat. No. 2,019,338 discloses tetrachloroethylene in a mixture predominantly of petroleum oil for use as a dielectric fluid in transformers.

U.S. Pat. No. 2,752,401 discloses a new process for preparing tetrachloroethylene.

SUMMARY OF THE INVENTION

We have found that tetrachloroethylene, when it is ultra pure, is an excellent dielectric fluid, either alone or mixed with a diluent.

Tetrachloroethylene has been around a long time, and, as "perchloroethylene," is widely used as a dry-cleaning fluid. It has even been suggested for use as a dielectric fluid (see U.S. Pat. No. 2,019,338) but has not been used commercially because it attacks the metals and insulation in the electrical apparatus (e.g., transformers and capacitors).

We have found, however, that it is not the tetrachloroethylene that is responsible for the chemical attacks, but rather the damage is due to the decomposition of various impurities which are associated with tetrachloroethylene.

We have identified these impurities as chlorohydrocarbons, compounds which have both chlorine and hydrogen atoms on the same molecule. While we do not wish to be bound by any theories, we believe that these chlorohydrocarbons form hydrochloric acid and/or chlorine gas, which attack the insulation and metals. Because hydrochloric acid acts as a catalyst for the decomposition of cellulose insulation extensively used in capacitors and transformers, very small quantities of hydrochloric acid can extensively damage a cellulose insulation system.

The method of manufacturing tetrachloroethylene used until the early 1950's inevitably concurrently produced significant quantities of various chlorohydrocarbons. Unless the tetrachloroethylene was purified by elaborate distillation, which was not commonly done, it would be entirely unsuitable for use as a dielectric fluid.

A current method of producing tetrachloroethylene has been developed (see U.S. Pat. No. 2,752,401). This new method can also produce chlorohydrocarbons, but the process parameters can be controlled so that very pure tetrachloroethylene is produced which can be used as a dielectric fluid.

We have found that ultra pure tetrachloroethylene can be mixed with various diluents to produce an excellent dielectric fluid. Alone or mixed in proper proportions with a suitable diluent, the fluid is non-flammable in that it has no fire point up to its boiling point and it will not sustain combustion once an ignition source is removed. Even if the fluid is vaporized in a high energy arc the mixture of gases is still non-flammable. The low viscosity of the fluid provides improved cooling of the electrical apparatus. The fluid is liquid over a wide temperature range and is less volatile than many other non-flammable fluids such as various fluorinated hydrocarbons. The fluid is relatively inexpensive and has good electrical properties, including dielectric strength.

DESCRIPTION OF THE INVENTION

FIG. 1 is a side view in section of a transformer containing the dielectric fluid of this invention.

FIGS. 2, 3, 4, and 5 are spectrograms explained in Example 1.

In FIG. 1, a transformer 1 is shown as comprising a sealed tank 2, a ferrous metal core 3 consisting of alternating layers of a conductor and an insulator, a primary coil 4, a secondary coil 5, and a dielectric fluid 6 which surrounds and covers the core and coils. The sealed tank 2, the core 3, and the coils 4 and 5 are of conventional construction. However, the dielectric fluid 6 is unique and will be described in detail hereinafter.

The dielectric fluid of this invention comprises ultra pure tetrachloroethylene, $C_2Cl_4$. The dielectric fluid is considered to be "ultra pure" if it contains less than 100 ppm of halohydrocarbons, particularly chlorohydrocarbons. A compound is a halohydrocarbon if it has both hydrocarbon and halogen in its molecule. For example, trichloroethylene, $C_2HCl_3$, dichloroethylene, $C_2H_2Cl_2$, unsymmetrical tetrachloroethane, $C_2H_2Cl_4$, and monochloroethylene $C_2H_3Cl$ are halohydrocarbons.

The tetrachloroethylene is preferably mixed with a diluent to extend its fluidity range, as tetrachloroethylene crystallizes at $-6°$ C. The tetrachloroethylene freezes out of a mixture, forming a slush which is still an effective insulator and has a lower freezing point than pure tetrachloroethylene. The diluent should be a compatible dielectric fluid such as mineral oil, silicone oil, polyalphaolefins, high molecular weight hydrocarbons, phthalate esters, or isopropyl biphenyl. Mineral oil is the preferred diluent because it is relatively inexpensive and has good low temperature properties, though silicone oil is also a good diluent. Preferably, mineral oil should meet ASTM B12-30 standards.

The dielectric fluid may contain up to about 80% by volume of a diluent, as more diluent may make the fluid flammable. At least 1% of the diluent should be used if a diluent is present as less is not worth the trouble. A preferred mixture is about 60 to about 80% by volume tetrachloroethylene and about 20 to about 40% by volume of a diluent. However, the dielectric fluid of this invention preferably contains no diluent because tetrachloroethylene by itself is a better coolant. Also, if a flammable diluent of higher boiling point is present the tetrachloroethylene will boil off when heated and then the diluent which remains may ignite.

In addition, the dielectric fluid of this invention also preferably includes about 30 to about 100 ppm of an inhibitor to prevent oxidation of the tetrachloroethylene by air. The inhibitor should reduce oxidation of tetrachloroethylene in both its liquid and gaseous state. The preferred concentration range of inhibitor is about 50 to about 75 ppm. The chemical identity of various widely used commercial inhibitors is kept proprietary by the manufacturers, but it is known that some of them are substituted phenols and cyclic amines.

The dielectric fluid of this invention preferably contains no ingredients other than the tetrachloroethylene, the diluent, and the inhibitor, though there may be occasions for adding other compounds. The fluid can be used in transformers, capacitors (especially all-film capacitors), or other electrical apparatus. The following examples further illustrate this invention.

EXAMPLE 1

In this example, two commercial samples of tetrachloroethylene were used, one prepared by the old technique of dehydrochlorination of other compounds using caustic or lime, designated "OLD" and the other prepared by the new process, designated "NEW" (see U.S. Pat. No. 2,752,401). Both samples contained less than 500 ppm of unknown stabilizers provided by the manufacturer.

Figure 2:
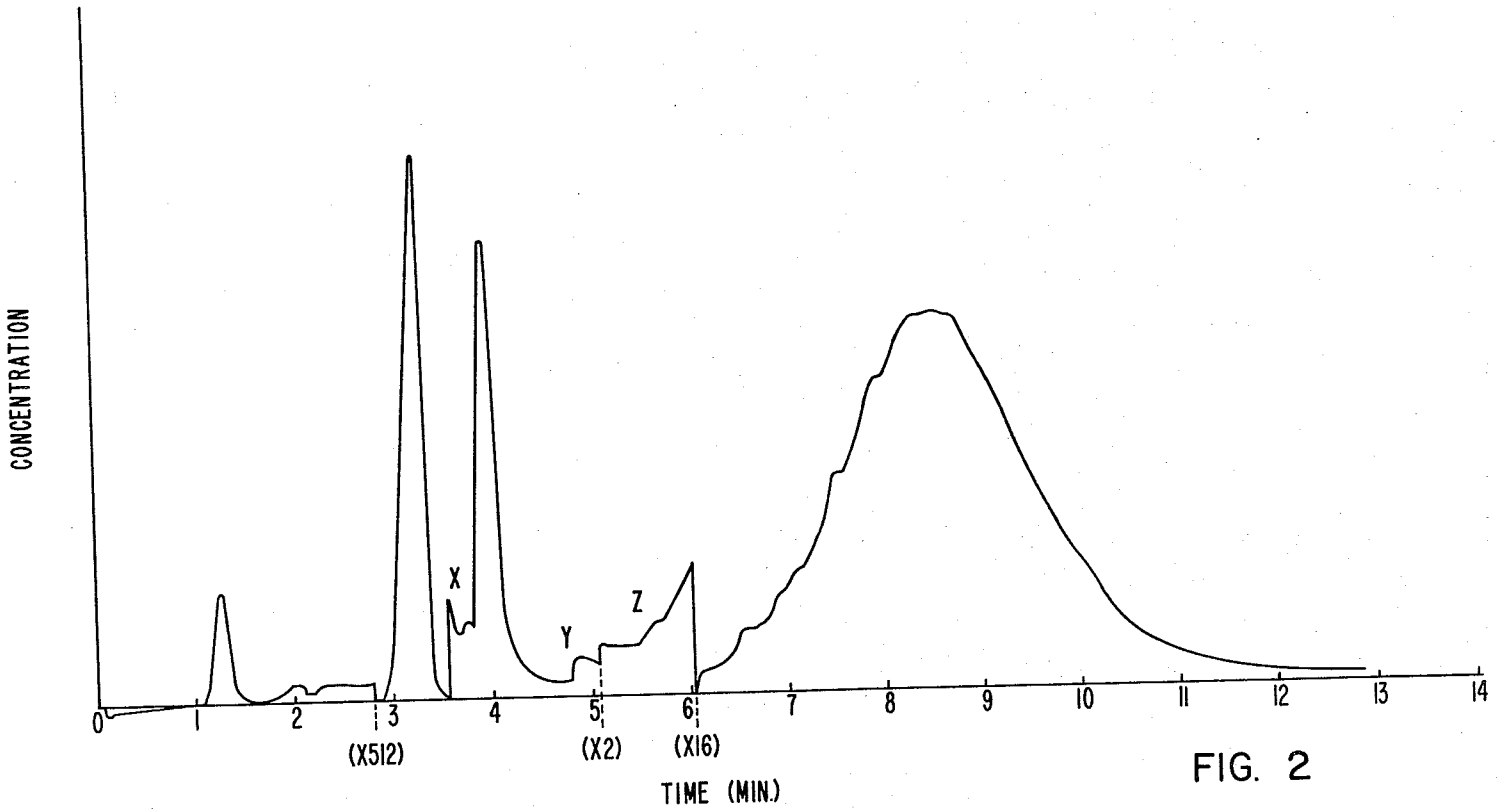
Figure 3:
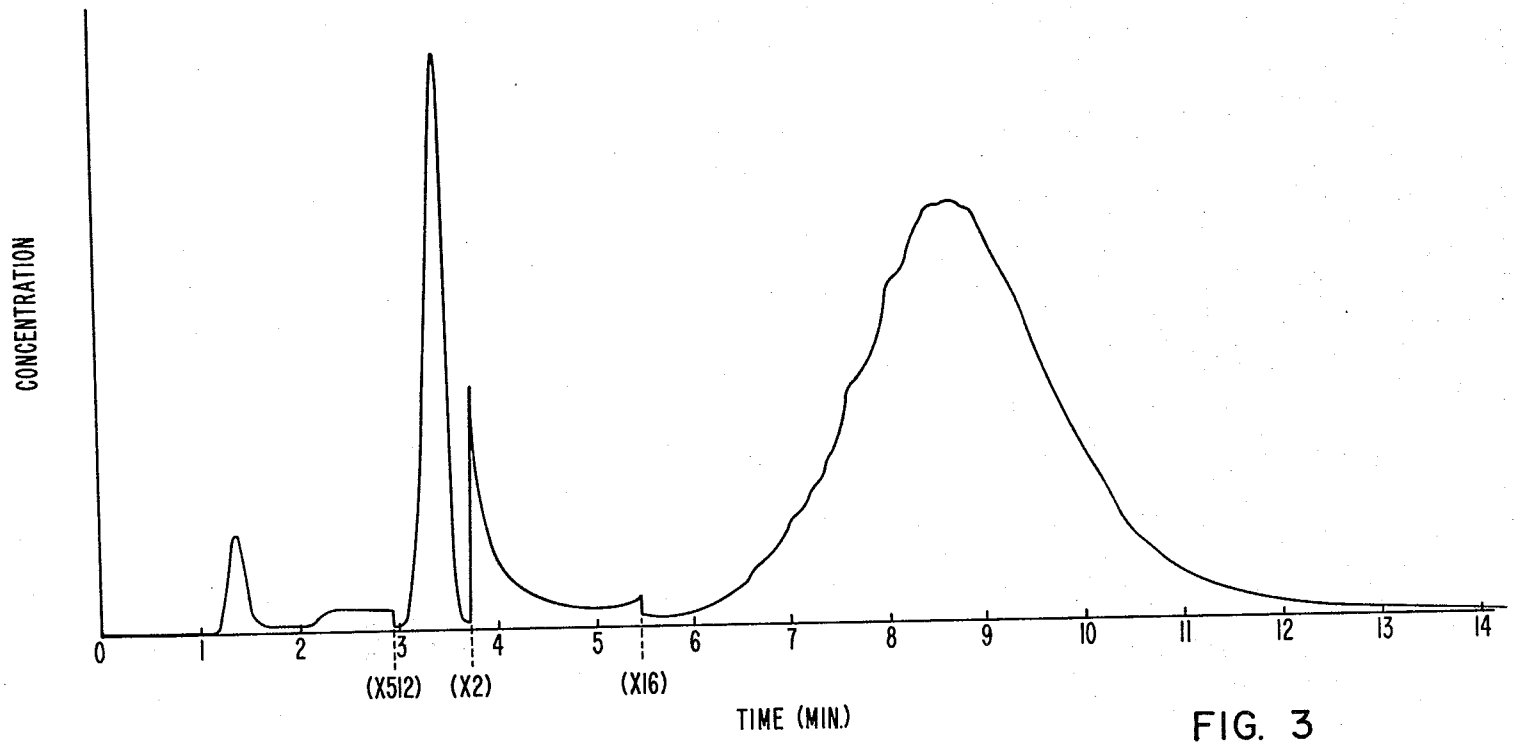

Each sample was mixed with mineral oil to produce a fluid which was 75% by volume $C_2Cl_4$ and 25% by volume mineral oil. Gas chromatography was performed on each fluid. FIG. 2 is the chromatogram of the fluid containing the OLD tetrachloroethylene. Traces of halohydrocarbons can be seen as the peaks X, Y, and Z in FIG. 2. Upon aging, these compounds decompose by the elimination of chlorine and hydrochloric acid. FIG. 3 is the chromatogram of the fluid containing the NEW tetrachloroethylene.

Figure 4:
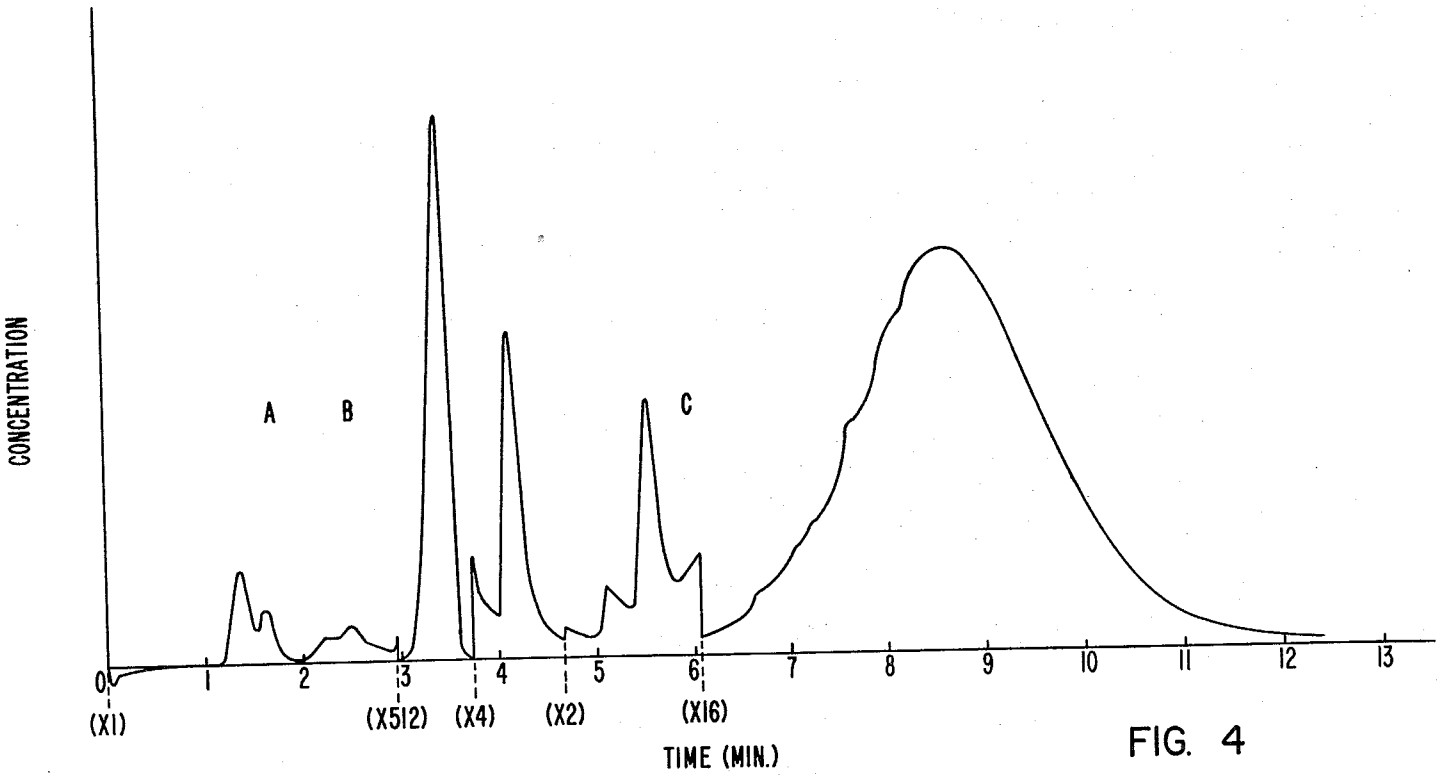
Figure 5:
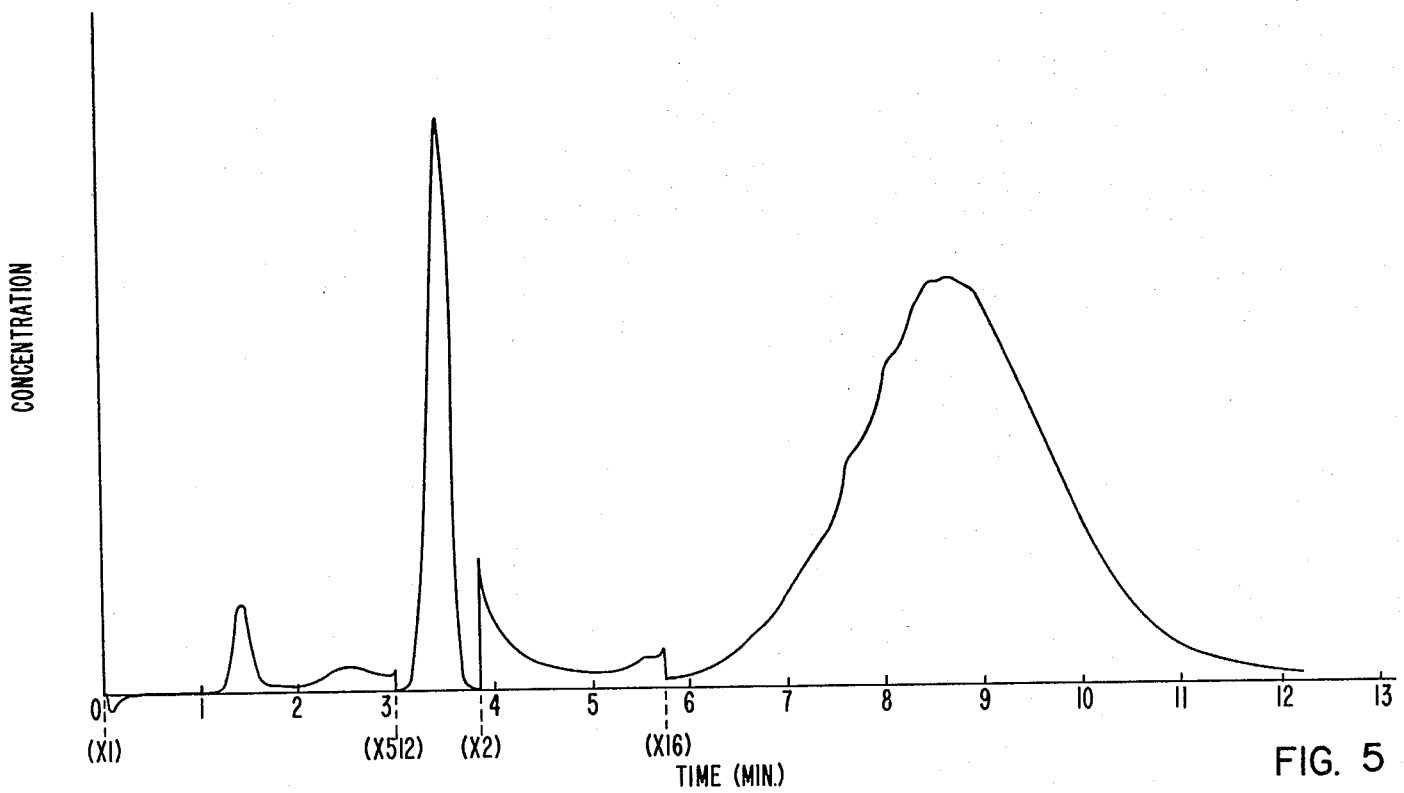

Each fluid was aged for 60 days at 150° C and was again analyzed in a gas chromatograph. FIG. 4 is the chromatogram of the fluid containing the OLD tetrachloroethylene and FIG. 5 is the chromatogram of the fluid containing the NEW tetrachloroethylene. The chromatograms indicate that the NEW fluid was substantially unchanged, but that significant amounts of decomposition products (see peaks labelled A, B, and C in FIG. 4) were formed in the OLD fluid. These decomposition products are believed to be due to the breakdown of chlorohydrocarbons in the OLD tetrachloroethylene. This breakdown produces hydrochloric acid and/or chlorine which attack metals and insulation, as the following example illustrates.

EXAMPLE 2

Samples of the OLD and NEW tetrachloroethylene, both neat (unmixed) and mixed with mineral oil as in Example 1, were heated for 20 days at 150° C. The NEW material yielded less than 1 ppm of chloride ion and the OLD material yielded greater than 20 ppm of chloride ion. When aged with copper the OLD tetrachloroethylene had greater than 20 ppm of soluble metal chlorides. All of the stabilizer was consumed in the OLD material during testing.

EXAMPLE 3

NEW tetrachloroethylene was mixed in various proportions with mineral oil and then tested for pour point and boiling point. The following data shows how the mineral oil lowers the pour point and raises the boiling point.

| % $C_2Cl_4$ | Pour Point (°C.) | Boiling Point (°C.) |
|---|---|---|
| 100% | −22 | 121.1 |
| 75% | −28 | 135 |
| 50% | — | 145 |

EXAMPLE 4

Samples of OLD and NEW tetrachloroethylene, both neat and in a 75%–25% by volume mixture with mineral oil were heated at 175° C. for 180 days. The samples were then tested for power factor, color, clarity, and acid number. The following table gives the result.

| Sample | Power Factor | Color Scale | Clarity | Acid Number |
|---|---|---|---|---|
| OLD-neat | 55.88 | Black | Sediment | 0.412 |
| OLD-25% oil | Beyond Limits | Black | Sediment | 0.936 |
| NEW-neat | 0.40 | L-1.5 | Clear | 0.044 |
| NEW-25% oil | 62.7 | L-7.0 | Sediment | 0.30 |

The above data show that the NEW tetrachloroethylene produces far less decomposition product on aging.

EXAMPLE 5

Mixtures of NEW tetrachloroethylene and mineral oil were prepared and tested for flammability. The fluids were repeatedly ignited with a torch and the time from the removal of the torch to extinguishment of the flame was measured. The following table gives the results.

| Mixture (by volume) | Average Time to Extinguish |
|---|---|
| 75% $C_2Cl_4$ - 25% oil | 1–2 seconds |
| 50% $C_2Cl_4$ - 50% oil | 1–3 seconds |
| 40% $C_2Cl_4$ - 60% oil | 4–7 seconds |

EXAMPLE 6

Mixtures of NEW tetrachloroethylene and mineral oil were prepared and tested for power and dielectric constant. The following table gives the results.

| Temperature | Mixture (by volume) | Dielectric Constant | Power Factor (100 Tanδ) |
|---|---|---|---|
| 25° C. | 100% $C_2Cl_4$ | 2.236 | 0.025 |
| | 75% $C_2Cl_4$ - 25% oil | 2.27 | 0.30 |
| | 50% $C_2Cl_4$ - 50% oil | — | — |
| | 100% oil | 2.2 | 0.01 |
| 100° C. | 100% $C_2Cl_4$ | | 0.94 |
| | 75% $C_2Cl_4$ - 25% oil | | 1.00 |
| | 50% $C_2Cl_4$ - 50% oil | | — |
| | 100% oil | | 0.10 |

EXAMPLE 7

Mixtures were prepared of silicone oil sold by Dow Corning under the trade designation DC561 and ultra pure tetrachloroethylene, and the pour point of the mixtures was measured. The following table gives the results:

| % $C_2Cl_4$ (by volume) | Silicone Oil (by volume) | Pour Point °C. | Pour Point °F. |
|---|---|---|---|
| 100 | 0 | −20 | −4 |
| 80 | 20 | −22 | −8 |
| 75 | 25 | −23 | −10 |
| 60 | 40 | −24 | −12 |
| 50 | 50 | −26 | −15 |
| 40 | 60 | −29 | −20 |
| 25 | 75 | −36 | −33 |

EXAMPLE 8

Nine test transformers containing cellulose insulation were filled with a mixture of 75% by volume ultra pure $C_2Cl_4$ plus 25% mineral oil and three identical monitor transformers were filled with 100% mineral oil. Due to the vapor pressure of $C_2Cl_4$ it was necessary to limit the vacuum to about 18 inches after filling to prevent extracting the $C_2Cl_4$. The filling procedure was to evacuate the transformer then close the exhaust valve and open the input valve admitting the liquid and after filling, pull a vacuum to about 18 inches, then admit dry nitrogen to atmospheric pressure (0 psig). The three control units were filled with oil under vacuum. The hot spot temperatures of the monitor units (oil only) were 160° C., 180° C. and 200° C.

The electrical ratings of the transformers were 10 kVA, single phase, Type S, 7200/12470 y to 120/240 volts, 60 Hertz.

The original cover was removed from each transformer and replaced with one fitted with a pressure gauge, a filling valve, a bottom sampling tube and valve and thermocouple gland to measure the liquid temperature. A second thermocouple gland was installed on the three control transformers to monitor and control the hot spot temperatures during the thermal aging cycle. Each transformer was sealed to 15 psig and 30 inches of vacuum before processing.

The processing consisted of connecting a pair of units to a power source and circulating a current in the high voltage winding, with the low voltage winding shorted, to heat the coil to about 125° C.

One of the 160° C. hot spot transformers failed at 4200 hours in the high voltage winding between turns. The ANSI minimum expected life curve for 65° C. rise distribution transformers aged at 160° C. hot spot is 2200 hours.

The units have accumulated the following hours without failures:

| H.S. Temp. | Accumulated Hours | ANSI Curve Values 65° C. Rise |
|---|---|---|
| 160° C. | 4500 | 2200 |
| 180° C. | 2500 | 500 |
| 200° C. | 1300 | 128 |

These values are considered to be very acceptable.

The following conclusions were reached:

1. The transformers filled with 75% $C_2Cl_4$ and 25% oil run 12° C. cooler than the 100% oil-filled unit at 180% load.

2. The liquid top level temperature was 14° C. cooler than the oil-filled unit at 180% load.

3. The gauge pressure was higher in the $C_2Cl_4$ mix units by about 4.8 psig than the oil units at 180% load.

4. The design is good for 25 times normal short circuit.

EXAMPLE 9

Sample #1 —This sample was 75% by volume ultra pure $C_2Cl_4$-25% mineral oil. The container holding the sample was evacuated and backfilled with a 1 pound/sq. inch nitrogen atmosphere. The liquid/gas mixture was allowed to equilibrate for 30 minutes and then a sample was collected by opening a valve and allowing the vapors to expand into a pre-evacuated collection volume. The sample consisted of the gases that were trapped in the sample chamber after closing suitable valves. All the samples were generated in this manner except as noted.

Sample #2—This sample was generated from #1 by passing an arc just below the surface of the solution for 10 seconds and collecting the gases as described above. The arc energy was 25 kVAC using a gap of 0.001 inches between stainless steel needles at room temperature.

Sample #3—This sample was generated from sample #2 with a 2-minute arcing time.

Sample #4—This sample was collected from sample #3 by pumping away the cover gas and collecting a sample when the solution started to bubble (boil under vacuum).

Sample #5—This sample was collected from sample #4 after a new blanket of nitrogen gas was introduced into the system and followed by a 10-minute arcing period.

Sample #6—This sample was collected from sample #5 by pumping away the cover gas and collecting a sample when the solution started to boil as in #4.

The samples were all analyzed by mass spectrometric methods. The peaks in each sample were scaled so that they would represent the same amount of $C_2Cl_4$. Peaks due to nitrogen had to be largely ignored since they were dependent on the original amount of nitrogen introduced and pumping losses that could not be controlled. On a qualitative basis there were no peaks detected that were due to a reaction between the $C_2Cl_4$ mixture and the nitrogen blanket.

Samples #4 and #6 were taken to see if there was anything in the liquid phase that was not in the gas phase or vice versa. There were not any detectable differences between the liquid phase and gas phase samples.

In sample #5, the new nitrogen blanket was added to replace the nitrogen pumped away to generate sample #4. The arcing time was increased to 10 minutes but no new peaks were detected.

Samples #1, #2, #3, and #5 formed a rate-type reaction since they are essentially the same reaction sampled at different times.

No evidence was found to indicate that the $C_2Cl_4$ and oil mixture produced any unusual products or any explosive gases (such as $CH_4$, $C_2H_6$, etc.).

We claim:

1. A transformer containing a dielectric fluid consisting essentially of tetrachloroethylene containing less than 100 ppm halohydrocarbons.

2. A transformer containing a dielectric fluid which comprises tetrachloroethylene, said dielectric fluid containing less than 100 ppm halohydrocarbon.

3. A transformer according to claim 2 wherein said dielectric fluid contains about 30 to about 100 ppm of an inhibitor to prevent oxidation.

4. A transformer according to claim 3 wherein said inhibitor is a substituted phenol inhibitor.

5. A transformer according to claim 2 wherein said dielectric fluid includes up to about 80% by volume of a diluent for said tetrachloroethylene.

6. A transformer according to claim 5 wherein said diluent is mineral oil.

7. A transformer according to claim 5 wherein said diluent is silicone oil.

8. A transformer according to claim 5 wherein said diluent is about 20 to about 80% by volume of said dielectric fluid.

9. A dielectric fluid which comprises about 20 to about 99% by volume tetrachloroethylene and about 1 to about 80% by volume of a diluent, said dielectric fluid containing less than 100 ppm of chlorohydrocarbon.

10. A dielectric fluid according to claim 9 wherein said dielectric fluid comprises about 60 to about 80% by volume tetrachloroethylene and about 20 to about 40% by volume of a diluent.

11. A dielectric fluid according to claim 9 wherein said diluent is mineral oil.

12. A dielectric fluid according to claim 9 wherein said diluent is silicone oil.

13. A dielectric fluid according to claim 9 which includes about 30 to about 100 ppm of an inhibitor to prevent oxidation.

14. A dielectric fluid according to claim 13 wherein said inhibitor is a substituted phenol.

15. An electrical apparatus containing a dielectric fluid consisting essentially of tetrachloroethylene containing less than 100 ppm halohydrocarbons.

* * * * *